United States Patent [19]

Harris

[11] Patent Number: 5,074,188

[45] Date of Patent: Dec. 24, 1991

[54] PIVOTAL BIPOD ADAPTER

[76] Inventor: Gerald Harris, Rte. 1, Box 33, Barlow, Ky. 42024

[21] Appl. No.: 630,174

[22] Filed: Dec. 19, 1990

[51] Int. Cl.[5] ..... F41A 23/08

[52] U.S. Cl. ..... 89/37.04; 42/94

[58] Field of Search ..... 42/94; 89/37.04

[56] References Cited

U.S. PATENT DOCUMENTS

| | | | |
|---|---|---|---|
| 861,939 | 7/1907 | Benet et al. . | |
| 879,052 | 2/1908 | Jeranek | 42/94 |
| 965,158 | 7/1910 | Cowles . | |
| 1,029,951 | 6/1912 | Seely . | |
| 1,295,688 | 2/1919 | Butler . | |
| 1,372,599 | 3/1921 | Butler . | |
| 1,746,364 | 2/1930 | Schuler . | |
| 1,827,557 | 10/1931 | Bradford . | |
| 1,890,423 | 12/1932 | Teagarden . | |
| 2,375,721 | 5/1945 | Woodhull . | |
| 2,489,283 | 11/1949 | Garand | 42/94 |
| 2,845,737 | 8/1958 | Hoyer . | |
| 2,933,843 | 4/1960 | McFeeter . | |
| 3,327,422 | 6/1967 | Harris | 42/94 |
| 4,393,614 | 7/1983 | Pickett | 42/94 |
| 4,470,216 | 9/1984 | Harris | 42/94 |
| 4,625,620 | 12/1986 | Harris | 89/37.04 |
| 4,641,451 | 2/1987 | Harris | 42/94 |
| 4,903,425 | 2/1990 | Harris | 42/94 |

FOREIGN PATENT DOCUMENTS

| | | | |
|---|---|---|---|
| 720365 | 5/1942 | Fed. Rep. of Germany | 42/94 |
| 763020 | 4/1934 | France . | |
| 286537 | 10/1953 | Switzerland . | |

*Primary Examiner*—Richard W. Wendtland

*Attorney, Agent, or Firm*—Harness, Dickey & Pierce

[57] ABSTRACT

An improved pivotal bipod adapter. The adapter allows pivoting of the bipod by use of a rubber hinge type member. The rubber hinge member connects a base member with a bipod mounting portion and holds the bipod in a normal position but is pivotal from side to side to allow for resting the bipod on uneven surfaces.

7 Claims, 1 Drawing Sheet

PIVOTAL BIPOD ADAPTER

BACKGROUND AND SUMMARY OF THE INVENTION

The present invention relates to bipods and mounting devices therefor. More particularly, the present invention relates to an improved pivotal bipod adapter for pivotally connecting a bipod to a firearm.

Modern firearms, such as rifles in particular, are more accurately and conveniently fired by the user if the firearm is equipped with a bipod device for supporting and steadying the barrel. Bipods may be fixedly or removably mounted onto firearms and have been found to be most convenient if they can be somehow retracted in a storage position when they are not in use. To increase effectiveness of bipods, the lightest in weight of such assemblies will produce the best results with regard to accuracy and change in point of bullet impact as compared to a gun without a bipod assembly. Lightweight bipods and mounts therefor are taught in my prior U.S. Pat. Nos.: 3,327,422, issued June 27, 1967; 4,470,216, issued Sept. 11, 1984; 4,625,620, Issued Dec. 2, 1986; and 4,641,451, issued Feb. 10, 1987; the disclosures of which are incorporated herein by reference thereto. While the bipods disclosed in these prior patents are extremely convenient, are easily adjusted and retracted and include various advantageous mounting assemblies, there remains a need for desirable improvements which have not heretofore been recognized, but are addressed in the present invention. For instance, while these prior bipod devices have adjustable length legs and are adjustable for various forward and reverse angles with respect to the barrel of the firearm, these bipods require time consuming adjustments in many cases. Adequate time for such adjustments is often not available in hunting or other shooting situations. These prior bipod assemblies also are not readily adaptable to use with slanted and irregular surfaces which are often encountered during hunting situations.

It has been desirable in recent years to provide a bipod which includes the above features, but which is pivotal with respect to the firearm for adapting to slanted surfaces and the like. One such pivotal bipod is shown in U.S. Pat. No. 2,489,283. While this discloses one pivotal configuration, the use of such a configuration in a sporting type firearm is not generally desirable since the barrel would tend to slant or easily teeter to the side during use of the bipod. My prior U.S. Pat. No. 4,903,425, discloses a greatly improved pivotal bipod assembly which is readily adapted to the above stated bipods and which allows controlled leveling of such bipods during use in sporting type situations.

While the above bipod adapter has greatly improved the art with respect to pivotal bipods, it has still been desirable to provide an improved pivotal adapter which is lighter in weight and less expensive to manufacture, while retaining advantageous characteristics of supporting the barrel in a normal position but allowing controlled pivoting of the barrel when desired.

In accordance with the present invention there is provided an improved pivotal bipod adapter which is less expensive in its manufacture and is lighter in weight than prior pivotal adapters. In accordance with the present invention, the pivotal adapter for a bipod includes a base member for attachment to a firearm. A bipod mounting portion is also provided which has a means for attachment of a bipod to the adapter. A hinge member is provided, which is made of a resilient flexible material, for operably connecting the base member and the bipod mounting portion, thereby allowing controlled pivoting therebetween. Further understanding of the present invention can be had by reference to the drawings and specification set forth below when taken in light of the appended claims.

DESCRIPTION OF THE PREFERRED EMBODIMENT

Figure 1:
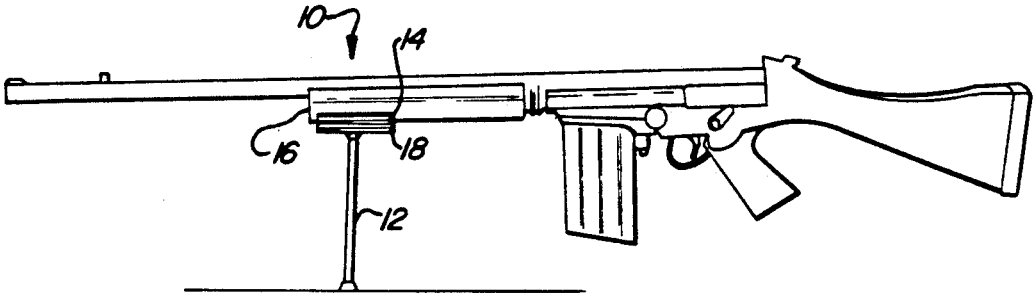
FIG. 1 is an elevational view showing the bipod adapter of the present invention attached to a firearm forestock.

In accordance with the present invention, there is provided an improved pivotal adapter, generally shown at 10 for a bipod 12. The pivotal adapter 10 of the present invention includes a base member 14 for attachment to the firearm 16. A bipod mounting portion 18 is provided which has a means such as quick disconnect screw 20 which allows attachment of the bipod 12 thereto as is known to those skilled in the art. A means for providing pivoting, such as hinge member generally shown at 22, is provided. Hinge member 22 is made of a flexible resilient material which operably connects the base member 14 and the bipod mounting portion 18 for allowing controlled pivoting therebetween.

Figure 2:
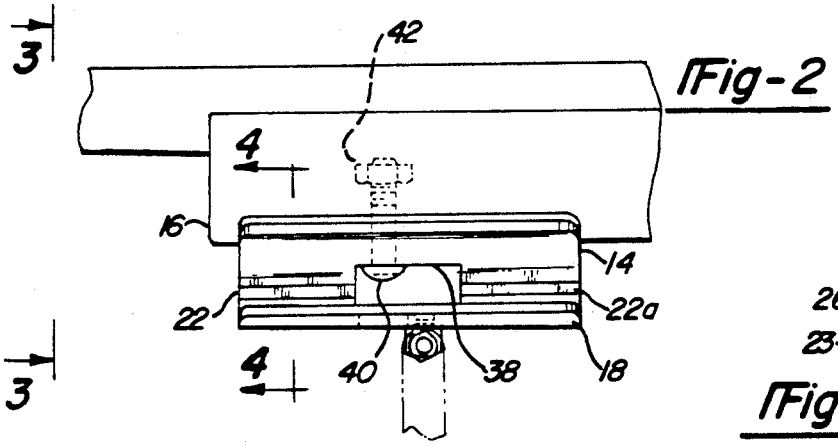
FIG. 2 is a detailed elevational view of a pivotal bipod adapter made in accordance with the teachings of the present invention.
Figure 3:
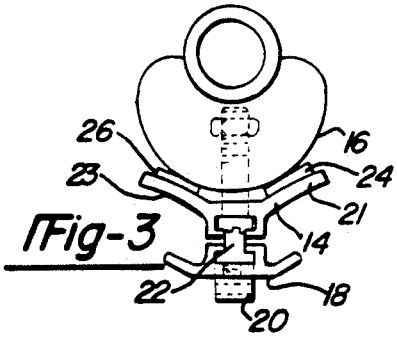
FIG. 3 is a front view of the pivotal bipod adapter taken along line 3—3 of FIG. 2.
Figure 4:
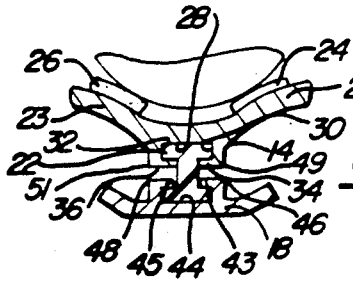
FIG. 4 is a sectional view taken along line 4—4 of FIG. 2.

Referring now to FIGS. 1 and 2, the base member 14 includes elongated cradling portions 21 and 23 which have pads 24 and 26 and is generally configured in a Y-shape for cradling of the forestock of the firearm 16. The base member 14 includes a T-shaped channel 28 which is formed by walls 30 and 32 in conjunction with the lips 34 and 36 which extend perpendicularly from the walls and toward one another forming L-shaped members which include corner portions 49 and 51. A central opening 38 is provided in the base member 14 which separates the channel into a pair of channel forming members. The central opening allows conventional attachment by way of screw 40 which is secured into the nut 42 as is provided in many conventional firearm stocks. While a single embodiment of a mounting bracket is shown herein, other types of attachments to firearms may be conveniently provided in accordance with the present invention. For instance, mounting brackets illustrated in more detail in my U.S. Pat. No. 4,903,425, which is hereby incorporated herein by reference, could be readily employed in the present invention as will be appreciated by those skilled in the art.

The bipod mounting portion 18 includes a similar T-shaped channel 44 therein running along its length and separated by the central space 38. The L-shaped legs 43 and 45 which form the channel portion 44 include corner portions 46 and 48 which interact with the corner portions 49 or 51 of member 14 forming the upper channel member 28 to provide outer limits to pivotal movement provided in the assembly.

The hinge member 22 is made out of a material such as a urethane, styrene butadiene styrene or other type rubber or rubber-like material. The material selected must be able to support the bipod in a normal position wherein the bipod legs are equally positioned on either side of the barrel of the gun for shooting on a flat surface, but must be yieldable to pivotal movement between the gun and the portion 18 for allowing matching of the gun to an uneven or tilted surface. The rubber material utilized should also be weather and tear resistant for greatest longevity.

Figure 5:
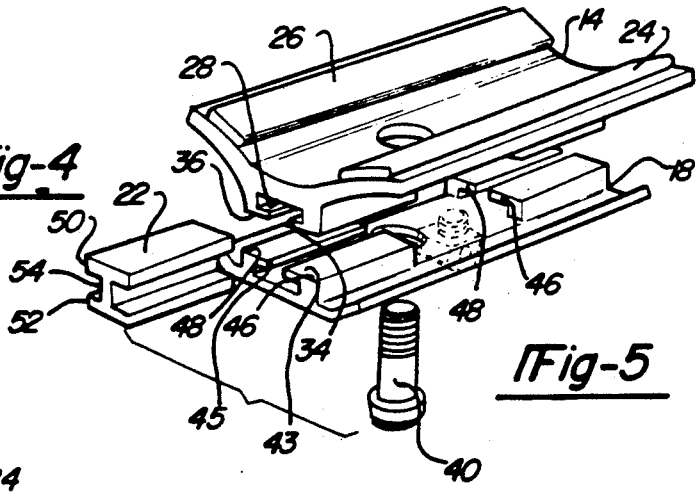
FIG. 5 is an exploded perspective view of the pivotal bipod adapter of the present invention.
Figure 6:
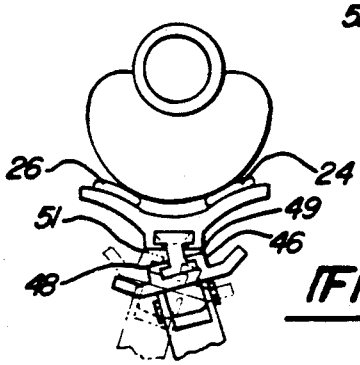
FIG. 6 is a view showing the pivotal aspects of the pivotal bipod adapter of the present invention.

In a preferred embodiment, two hinge members 22 and **22*a* are provided for insertion into the channels 28 and 44 on either side of the opening 38. The hinge portions 22 and 22*a* have an I-shaped cross-section and are elongated for fitting in the channels 28 and 44 thereby connecting the bipod mounting portion 18 to the base portion 14. With reference to FIG. 5, the hinge portion 22 is shown in more detail. Hinge portion 22*a* is not shown in FIG. 5 but is identical to hinge portion 22. Hinge portion 22 (and 22*a*) includes upper leg 50 and lower leg 52 which are connected by the central elongate web 54 for forming the I-shaped cross-section. The I-shaped cross-section of the hinge is provided with the elongate web 54 being of a width for spacing portions 50 and 52 such that hinging of the two members 22 and 22*a* causes interference at the limits of pivoting between one of the corners 49 or 51 of the base 14 and one of the corners 46 or 48 of the mounting bracket 18, thereby limiting total pivotal movement as best illustrated in FIG. 6**.

Thus, in accordance with the present invention, a bipod adapter is provided in a lighter weight configuration than prior pivotal adapters which have the advantage of resiliently responding to firing of the gun for increasing accuracy and reducing change in point of bullet impact, which may be due to the weight of the bipod. Additionally, because the hinge is made from a rubber material the adapter is relatively quiet in use which is an advantage in a bipod adapter for a firearm.

The foregoing description and accompanying drawings illustrate a merely exemplary embodiment of the present invention. Various changes, modifications and variations may be made therein without departing from the spirit and scope of the invention as defined in the following claims.

What is claimed is:

1. A pivotal adapter for attaching a bipod to a firearm comprising:

a base member including a means for attachment to a firearm;

a bipod mounting portion having a means for attachment of a bipod;

a means for providing pivoting along a plane which is substantially perpendicular to an axis of the barrel of the firearm between said base member and said bipod mounting portions, said means comprising an elongate hinge member made of a flexible resilient material operably connected between said base member and said bipod mounting portion for allowing pivoting therebetween.

2. A pivotal adapter for attaching a bipod to a firearm comprising:

a base member including a means for attachment to a firearm;

a bipod mounting portion having a means for attachment of a bipod;

a means for providing pivoting between said base member and said bipod mounting portion, said means comprising an elongate rubber hinge member operably connected between said base member and said bipod mounting portion for allowing pivoting therebetween.

3. The pivotal adapter of claim 2 further comprising a means for providing elongate T-shaped channels in said base member and said bipod mounting portion; said hinge means further comprising an elongate resilient rubber hinge portion having an I-shaped cross-section for operably connected said T-shaped channels to provide a pivotal connection therebetween.

4. The pivotal adapter of claim 3 wherein said means for providing elongate T-shaped channels further includes corner portions which interfere with one another during pivoting between said base member and said bipod mounting portion for limiting of pivotal movement therebetween.

5. A pivotal adapter for attaching a bipod to a firearm comprising:

a base member including a means for attachment of said base member to a firearm; said base member including surfaces forming an elongate T-shaped channel therein;

a bipod mounting portion including a means for attachment of a bipod thereto, said bipod mounting portion including a T-shaped channel formed therein;

a resilient rubber hinge portion having an I-shaped cross-section fitted into the T-shaped channels of said base member and said bipod mounting portion for connecting said base member to said bipod mounting portion, wherein said hinge portion normally holds said bipod in a first normal position but allows pivoting between the bipod and the firearm for adjusting to uneven surfaces and is resilient for returning to said normal position.

6. The pivotal adapter of claim 5 wherein said base member and said bipod mounting portion include a stop portion on either side of said T-channels which interfere with one another for limiting of pivotal movement between said base member and said bipod mounting portion.

7. A pivotal adapter for attaching a bipod to a firearm comprising:

a base member including a means for attachment to a firearm, said base member including a portion extending therefrom which includes a pair of spaced T-shaped channels each defined by a first pair of walls extending therefrom in a first direction and a second pair of walls extending inwardly therefrom forming opposed L-shaped legs;

a bipod mounting portion including a means for providing attachment of a bipod thereto; said bipod mounting portion including a pair of spaced T-shaped channels each defined by a second pair of first walls extending in a first direction and a pair of second walls extending in a second direction forming two pairs of L-shaped leg members;

a pair of resilient hinge members having T-shaped cross-sections, said hinge members fitted into the pairs of T-shaped channel of the base member and the bipod mounting portion for connecting said base member to said bipod mounting portion, wherein said pair of hinge members normally hold the bipod in a first normal position but allows pivoting between the bipod and the firearm for adjusting to uneven surfaces and is resilient for returning to said normal position.

* * * * *

UNITED STATES PATENT AND TRADEMARK OFFICE

CERTIFICATE OF CORRECTION

PATENT NO. : 5,074,188

DATED : December 24, 1991

INVENTOR(S) : Gerald Harris

It is certified that error appears in the above-identified patent and that said Letters Patent is hereby corrected as shown below:

Column 4, line 12, claim 3, "connected" should be --connecting--

Column 4, line 61, claim 7, "channel" should be --channels--

Signed and Sealed this

Thirteenth Day of July, 1993

*Attest:*

Michael K. Kirk

MICHAEL K. KIRK

*Attesting Officer*

*Acting Commissioner of Patents and Trademarks*